US006686681B1

(12) United States Patent
Allgeier et al.

(10) Patent No.: US 6,686,681 B1
(45) Date of Patent: Feb. 3, 2004

(54) DISCHARGE LAMP WITH BASE

(75) Inventors: Claus Allgeier, Bergisch-Gladbach (DE); Ulrich Genger, Cologne (DE); Hans-Juergen Keck, Engelskirchen (DE); Reinhold Wittkoetter, Wermelskirchen (DE)

(73) Assignee: Patent-Treuhand-Gesellschaft fuer Elektrische Gluelampen mbH, Munich (DE)

( * ) Notice: Subject to any disclaimer, the term of this patent is extended or adjusted under 35 U.S.C. 154(b) by 0 days.

(21) Appl. No.: 09/701,930

(22) PCT Filed: Feb. 19, 2000

(86) PCT No.: PCT/DE00/00478

§ 371 (c)(1),
(2), (4) Date: Dec. 6, 2000

(87) PCT Pub. No.: WO00/62330

PCT Pub. Date: Oct. 19, 2000

(30) Foreign Application Priority Data

Apr. 14, 1999 (DE) ..... 199 16 877

(51) Int. Cl.[7] ..... H01J 5/50
(52) U.S. Cl. ..... 313/318.01; 313/607; 313/234
(58) Field of Search ..... 313/318.01, 318.08, 313/318.06, 318.07, 318.05, 607, 581, 620, 623, 234

(56) References Cited

U.S. PATENT DOCUMENTS

| | | | | |
|---|---|---|---|---|
| 2,847,603 A | * | 8/1958 | Engelbart | 313/589 |
| 4,138,621 A | | 2/1979 | Downing et al. | |
| 5,164,630 A | | 11/1992 | Greiler et al. | |
| 5,808,402 A | * | 9/1998 | Seiler et al. | 313/318.01 |
| 5,831,394 A | | 11/1998 | Huber et al. | |
| 5,965,988 A | * | 10/1999 | Vollkommer et al. | 315/246 |

FOREIGN PATENT DOCUMENTS

| | | |
|---|---|---|
| EP | 0 433 916 | 6/1991 |
| GB | 433274 | 8/1935 |
| GB | 2107110 | 4/1983 |
| WO | 92/12526 | 7/1992 |
| WO | 94/23442 | 10/1994 |
| WO | 98/11596 | 3/1998 |

OTHER PUBLICATIONS

Patent Abstracts of Japan vol. 008, No. 256 (E–280), Nov. 22, 1984 & JP 59 128754 A (Toushiba Denzai KK), Jul. 24, 1984 abstract.

* cited by examiner

*Primary Examiner*—Edward J. Glick
*Assistant Examiner*—Elizabeth Gemmell
(74) *Attorney, Agent, or Firm*—Robert F. Clark

(57) ABSTRACT

A discharge lamp (1) with a base (2), suitable for operation by means of a dielectrically impeded discharge, has a spacing between the base (2) and the outer wall of the discharge vessel (3). The overall efficiency of the generation of UV radiation is improved thereby.

21 Claims, 1 Drawing Sheet

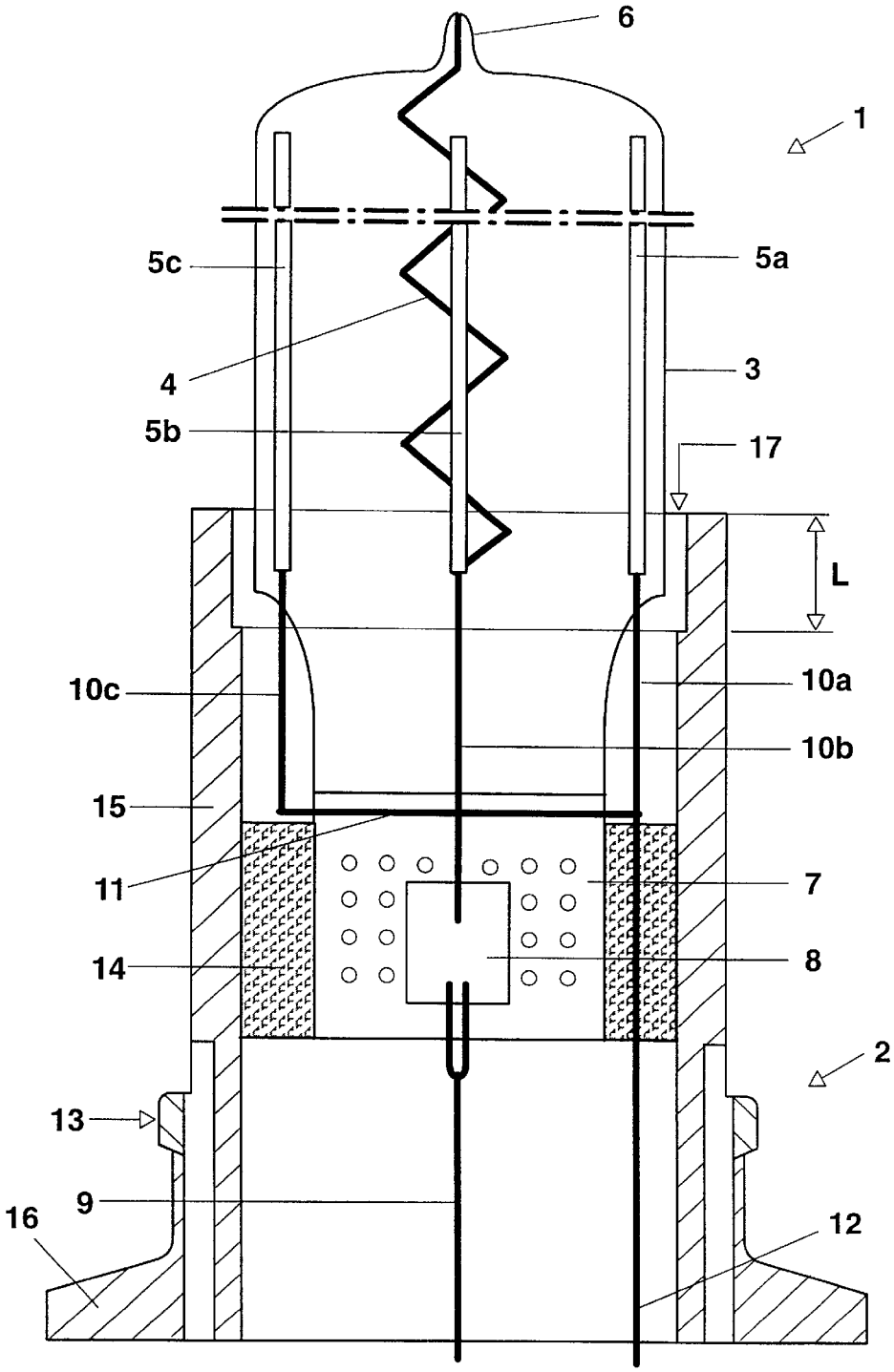
6
1
5c
5a
4
3
5b
17
L
10c
10a
10b
15
11
7
14
8
2
13
9
16
12

DISCHARGE LAMP WITH BASE

BACKGROUND OF THE INVENTION

1. Technical Field

The invention proceeds from a discharge lamp with a base in accordance with the preamble of claim 1.

The term "discharge lamp" in this case comprises sources of electromagnetic radiation based on gas discharges. The spectrum of the radiation can in this case comprise both the visible region and the UV (ultraviolet)/VUV (vacuum ultraviolet) region and the IR (infrared) region. Furthermore, a fluorescent layer can also be present for converting invisible radiation into visible radiation (light).

This is a discharge lamp with at least one so-called dielectrically impeded electrode. A dielectrically impeded electrode is separated from the interior of the discharge vessel by means of a dielectric. This dielectric can be designed, for example, as a dielectric layer covering the electrode, or it is formed by the discharge vessel of the lamp itself, specifically where the electrode is arranged on the outer wall of the discharge vessel.

2. Prior Art

Document WO-A-98/11596, in particular FIGS. 5*a* to 5*c*, has already disclosed such a lamp with an Edison screw base. This lamp has a helical electrode inside the discharge vessel. Moreover, four strip-shaped electrodes are arranged on the outer wall of the discharge vessel. It is disadvantageous in the case of this lamp that starting difficulties can occur, and that the radiant yield can be surprisingly low.

At the present stage of knowledge, the following relationships are being associated with this problem without the aim of thereby settling on any sort of theoretical interpretation. It is likely that displacement currents and leakage currents occur in the base. The discharge is thereby impaired and the radiant yield drops.

SUMMARY OF THE INVENTION

It is the object of the present invention to avoid the aforementioned difficulties and to provide a discharge lamp with a base in accordance with the preamble of claim 1 which has an improved radiant yield.

The invention also relates to a system having this discharge lamp with a base and a circuit arrangement which is designed for a pulsed active power injection into the discharge lamp.

The basic idea of the invention consists in providing a spacing between the base and the outer wall of the discharge vessel. Specifically, it has proved that the problems outlined at the beginning are avoided entirely simply once the spacing is sufficiently large. Moreover, the supply leads of the outer electrodes are arranged in such a way that their spacing from the inner electrode, or the supply lead of the inner electrode does not undershoot the spacing between each outer and inner electrode. Provided for this purpose are means which prevent the supply leads of the outer electrodes from touching the outer wall of the discharge vessel at the points at which the outside diameter of the discharge vessel is smaller than at the point where the supply leads make contact with the outer electrodes. This relates first and foremost to the stem, at the start of which the discharge vessel usually tapers. Consequently, provided here as means is an electric conductor, surrounding the longitudinal axis of the discharge lamp, with which the supply leads of all the outer electrodes make suitable contact. A metal ring arranged concentrically with the lamp longitudinal axis is, for example, suitable, its diameter being at least twice the spacing between the inner electrode and a contact point of a supply lead with an outer electrode. An adequate spacing between the supply leads of the outer electrodes and the stem is ensured in this way. Alternatively, the electric conductor can also be designed as a metal disk which has a cutout for holding the stem. Reference may be made to the description of the exemplary embodiments for further details on this.

The base is pulled up slightly over the discharge vessel in such a way that the supply leads of the outer electrodes and the metal ring or sheet-metal disk are protected by the base against inadvertent contact.

The base is fastened on the stem of the lamp with the aid of a fastening means. It is possible in this way to implement the required spacing from the outer wall of the discharge vessel. More detail on this is to be found in an exemplary embodiment.

A casting compound, for example, is suitable as fastening means. The base has a base shell for this purpose. At least a subregion of the space between the base shell and the stem is sealed with the aid of the casting compound. The base is fastened on the stem in this way. What is decisive in this case is that both the base shell and the casting compound have a sufficient spacing from the gas space enclosed by the wall of the discharge vessel, in particular from the part of the discharge vessel in which the dielectrically impeded discharge takes place during operation of the lamp.

This can be implemented, on the one hand, by having the casting compound cover only a subregion of the stem, for example at the end of the stem remote from the discharge vessel. Of course, when selecting the size of the subregion it must be ensured that the lamp and base are still interconnected with sufficient reliability.

Moreover, the typical minimum spacing between the outer wall of the discharge vessel and the inner wall of the base shell is of the order of magnitude of one to several millimeters. Given the usual tolerances of the diameters of the discharge vessel and of the base shell as well as of the centering of the discharge vessel in the base shell, this has proved itself in practice for the purpose of ensuring a sufficient spacing overall, and thus of ensuring a high radiant yield of the lamp.

Located inside the discharge vessel is an ionizable filling which preferably contains at least one inert gas, for example, xenon or krypton, and additionally, as an alternative, halogens or fluorides for forming excimers. The dielectrically impeded discharge thereby generates intensive UV/VUV radiation during operation of the lamp.

If the lamp is used as a UV/VUV emitter, that is to say has no fluorescent layer for converting the shortwave radiation, it is necessary to select materials which are as UV/VUV-resistant as possible, both for the casting compound and for the base shell. Glass, ceramic, specific Teflon-like plastics, for example PVDF (polyvinylidene fluorides) or generally UV-resistant PTFE (polytetrafluoroethylene=Teflon)-related plastics, and metals are particularly suitable for the base shell. Ceramic cement, epoxy resin or Sauereisen cement have proved to be suitable materials for the casting compound.

A particularly high radiant yield can be achieved using the lamp according to the invention with a base when it is operated in accordance with the method described in WO-A-94/23442 for the purpose of pulsed active power injection.

For this purpose, the lamp with a base is completed to form a system by a circuit arrangement which is designed for a sequence of pulsed active power injections into the discharge lamp. The individual active power injections are separated from one another by dead times. Pulse widths and dead times are tuned to one another in accordance with the teaching disclosed in WO-A-94/23442 in such a way that the radiant yield is optimum.

BRIEF DESCRIPTION OF THE DRAWINGS

The invention is to be explained in more detail below with the aid of an exemplary embodiment. In the drawing:

The FIGURE shows a discharge lamp with a flange-type base.

DETAILED DESCRIPTION OF THE INVENTION

A discharge lamp 1 (front view) with a flange-type base 2 (section) is illustrated schematically in the FIGURE. This is a UV/VUV emitter for UV irradiation, for example surface cleaning, photolysis, ozone generation, metalizing, UV curing and others.

The discharge lamp 1 has a circular cylindrical discharge vessel 3 made from quartz glass with a thickness of 0.7 mm to 1.5 mm. The discharge vessel 3 has an outside diameter of approximately 40 mm. The interior of the discharge vessel 3 is filled with xenon at a pressure of 15 kPa.

Arranged centrally inside the discharge vessel 3 is an elongated spiraled inner electrode 4 made from metal wire. The respective diameters of the metal wire and the helix are 1 mm and 8 mm, respectively. The pitch h —that is to say the distance within which the helix executes a complete revolution—is 12 mm. Six outer electrodes 5*a*–5*f* (the outer electrodes 5*d*–5*f* are not to be seen in the FIGURE) in the form of platinum strips 12 cm long are fitted on the outer wall of the discharge vessel 3 in a fashion equidistant and parallel to the longitudinal axis of the helix.

Details on the mode of operation of the electrodes during the operation of the lamp are described in the already cited WO-A-98/11596, in particular in the description relating to FIGS. 5*a* to 5*c*, the disclosure of which is incorporated here by reference.

The discharge vessel 3 is sealed in a dome-like fashion at a first end, and has a tip 6 in the middle of the dome, in which a first end of the helical electrode 4 is fixed. The discharge vessel 3 tapers in the region of the stem opposite the tip 6 and merges into a pinch seal 7. With the aid of a sealing foil 8 made from molybdenum, the pinch seal 7 ensures a gastight connection between the helical electrode 4 and an outer supply lead 9. At the tapering end of the discharge vessel 3 near the seal, the outer electrodes 5*a*–5*f* are connected to one supply lead 10*a*–10*f* each (the supply leads 10*d* to 10*f* are not to be seen in the FIGURE), which are connected for their part in turn to one another with the aid of a wire ring 11 made from nickel. Finally, the wire ring 11 is connected to a supply lead 12 leading to the outside. This outer supply lead 12 consequently serves as a common supply lead for all the outer electrodes 5*a*–5*f*. The diameter of the wire ring 11 corresponds approximately to the diameter of the discharge vessel 3.

The base 2 (illustrated in section) comprises a rotationally symmetrical base shell 13 and a casting compound 14 made from ceramic cement. The base shell 13 has a tubular part 15 which merges at its end remote from the lamp into a flange-type part 16. Along a part of the entire length of the pinch seal 7, the casting compound 14 fills up the space between this part of the pinch seal 7 and the base shell 13. The base shell 13 is fixed in this way on the stem or on the pinch seal 7 of the lamp 1 by means of the casting compound 14. The base shell 13 also envelopes a subregion, close to the pinch seal, of the discharge vessel 3 into which the helical electrode 4 and the outer electrodes 5*a*–5*f* additionally extend.

The flange-type part 16 serves the purpose of connecting in a process chamber for the purpose of UV irradiation. If the casting compound 14 is selected from a suitable material with an appropriately low vapor pressure, the emitter is also suitable for operating in evacuable apparatuses.

The function of the pulled-up base shell is primarily to protect the supply leads or the contacts between the supply leads and outer electrodes. This is required because the supply leads of the outer electrodes are in no way permitted to bear against the tapering part of the discharge vessel, and are therefore arranged concentrically around the stem in the manner of a crown. The pulled-up base shell then prevents the supply leads of the outer electrodes from coming undesirably close to the stem by being Inadvertently touched, or even from coming into contact with it. On the other hand, to be precise there are formed between such a point of contact and the inner electrode bright constricted discharge channels with high current densities which leads to a reduction in the overall efficiency of the UV radiation of the emitter.

The geometrical dimensions of the discharge vessel 3 and the base shell 13 are tuned to one another such that an annular gap 17 with a width of approximately 3 mm is formed between the outer wall of the discharge vessel 3 and the inner wall, opposite thereto, of the base shell 13. For this purpose, the inner wall of the base shell 13 has a cylindrical depression, with an inside diameter of 44 mm, along a length L of approximately 11 mm in the region of the discharge vessel. The inside diameter of the remaining base shell 13 in the region of the tapering of the stem is, by contrast, only 42 mm.

In an alternative which is not illustrated, the wire ring 11 is designed as a sheet-metal disk (partition) made from stainless steel, for example. The partition has a cutout which is adapted to the shape of the circumference of the pinch seal of the lamp. As a result, the sheet-metal disk can be pushed with geometrical accuracy over the pinch seal. The sheet-metal disk is arranged in this case in the region of the pinch seal, that is to say at an adequate spacing from the actual discharge vessel, such that no parasitic gas discharges can impair the efficiency of the lamp. The sheet-metal disk on the one hand has the same function as the previously described wire ring, specifically to make the electric contact between the outer electrodes and the supply lead. On the other hand, however, the sheet-metal disk additionally serves to protect the base cement against the UV radiation generated by the gas discharge. For this purpose, the outside diameter is selected to be so large that the entire casting compound is covered between the pinch seal and base shell. A further advantage consists in that during production of the lamp the initially soft casting compound can be filled in between the base shell and pinch seal without allowing the latter to run past the sheet-metal disk onto the discharge vessel.

In a variant (not illustrated) for illuminating purposes, the discharge lamp has a fluorescent layer which converts the UV/VUV radiation into light (visible electromagnetic radiation).

In a further variant (not illustrated), the supply leads led out of the base are connected to the terminals of a ballast which supplies the voltage pulses required to operate the lamp. A circuit arrangement suitable for this purpose is to be found, for example, in EP-A-0 781 078, the disclosure of which is hereby incorporated by reference.

What is claimed is:

1. A discharge lamp comprising:

a base, a discharge vessel enclosing an ionizable filling, an inner electrode arranged inside the discharge vessel, and outer electrodes fitted on the outer wall of the discharge vessel;

the discharge vessel having a stem through which the inner electrode is connected in a gas-tight fashion to a first outer supply lead, the stem being fastened to the base;

the outer electrodes being connected to supply leads, the spacing between the supply leads of the outer electrodes and the inner electrode being not less than the spacing between the outer electrodes and the inner electrode, the supply leads of the outer electrodes being connected to an electric conductor, the electric conductor surrounding the stem and being connected to a second outer supply lead.

2. The discharge lamp of claim 1 wherein the base is pulled up slightly over the discharge vessel to protect the supply leads of the outer electrodes and a spacing is provided between the base and the outer wall of the discharge vessel.

3. The discharge lamp of claim 2 wherein the spacing between the base and the outer wall of the discharge vessel is at least 1 mm.

4. The discharge lamp of claim 1 wherein the stem is fastened to the base by a casting compound.

5. The discharge lamp of claim 4 wherein the casting compound covers only a subregion of the stem.

6. The discharge lamp of claim 4 wherein the casting compound is selected from a ceramic cement, epoxy resin, or Sauereisen cement.

7. The discharge lamp of claim 1 wherein the electric conductor is a metal ring arranged concentrically with a longitudinal axis of the discharge lamp.

8. The discharge lamp of claim 7 wherein the diameter of the metal ring is at least twice the spacing between the outer electrodes and the inner electrode.

9. The discharge lamp of claim 1 wherein the electric conductor is a metal disk having a cutout for holding the stem.

10. The discharge lamp of claim 9 wherein the base is fastened to the stem by a casting compound and the metal disk covers the casting compound into a flange.

11. The discharge lamp of claim 1 wherein the base has a remote end which merges into a flange.

12. A discharge lamp comprising:

a base, a circular cylindrical discharge vessel enclosing an ionizable filling, an elongated spiraled inner electrode centrally arranged inside the discharge vessel, and outer electrodes fitted on the outer wall of the discharge vessel, the outer electrodes being equidistant and parallel to the longitudinal axis of the inner electrode;

the discharge vessel having a stem through which the inner electrode is connected in a gas-tight fashion to a first outer supply lead, the stem being fastened to the base;

the outer electrodes being connected to supply leads, the spacing between the supply leads of the outer electrodes and the inner electrode being not less than the spacing between the outer electrodes and the inner electrode, the supply leads of the outer electrodes being connected to an electric conductor, the electric conductor surrounding the stem and being connected to a second outer supply lead.

13. The discharge lamp of claim 12 wherein the base is fastened to the stem by a casting compound.

14. The discharge lamp of claim 12 wherein the base comprises a rotationally symmetrical base shell having a tubular part and a flange, the base shell enveloping the stem of the discharge vessel and a subregion into which the inner electrode and the outer electrodes extend.

15. The discharge lamp of claim 14 wherein the inner wall of the base shell has a cylindrical depression in the region of the discharge vessel.

16. The discharge lamp of claim 15 wherein there is an annular gap between the outer wall of the discharge vessel and the base shell.

17. The discharge lamp of claim 12 wherein the electric conductor is a wire ring having a diameter corresponding approximately to the diameter of the discharge vessel.

18. The discharge lamp of claim 12 wherein the stem has a pinch seal and the electric conductor is a metal disk having a cutout adapted to the shape of the circumference of the pinch seal.

19. The discharge lamp of claim 18 wherein the base comprises a rotationally symmetrical base shell having a tubular part and a flange, the base shell enveloping the stem of the discharge vessel and a subregion into which the inner electrode and the outer electrodes extend, the base shell being fixed to the stem by a casting compound.

20. The discharge lamp of claim 19 wherein the metal disk covers the casting compound.

21. The discharge lamp of claim 12 wherein the supply leads of the outer electrodes are arranged concentrically around the stem.

* * * * *